US006910735B2

(12) United States Patent
Asbach et al.

(10) Patent No.: US 6,910,735 B2
(45) Date of Patent: Jun. 28, 2005

(54) ADJUSTABLE SUPPORT STRUCTURE AND METHOD OF USING THE SAME

(75) Inventors: Ronald M. Asbach, Grand Island, NY (US); Michael T. Kane, Conesus, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/286,955

(22) Filed: Nov. 4, 2002

(65) Prior Publication Data

US 2004/0084941 A1 May 6, 2004

(51) Int. Cl.[7] ..... A47C 3/025

(52) U.S. Cl. ..... 297/284.3; 297/112; 297/114; 297/284.9; 297/452.34; 297/464

(58) Field of Search ..... 297/284.3, 112, 297/113, 114, 284.1, 284.9, 452.34, 452.4, 464

(56) References Cited

U.S. PATENT DOCUMENTS

| | | | | |
|---|---|---|---|---|
| 1,538,538 A | | 5/1925 | Wood | |
| 2,619,157 A | | 11/1952 | Guyton et al. | |
| 2,707,988 A | | 5/1955 | Shaub et al. | |
| 3,608,960 A | * | 9/1971 | Sherman | 297/284.9 |
| 3,962,738 A | | 6/1976 | Menditto | |
| 4,241,458 A | | 12/1980 | Lesesne | |
| 4,500,136 A | | 2/1985 | Murphy et al. | |
| 4,537,444 A | | 8/1985 | Maruyama et al. | |
| 4,603,902 A | | 8/1986 | Maloney | |
| 4,636,000 A | | 1/1987 | Nishino | |
| 4,653,805 A | | 3/1987 | Maloney | |
| 4,674,800 A | | 6/1987 | Ensign | |
| 4,696,514 A | | 9/1987 | Maloney | |
| 4,773,702 A | | 9/1988 | Takahashi et al. | |
| 4,793,652 A | | 12/1988 | Hannah et al. | |
| 4,804,221 A | * | 2/1989 | Saiki | 297/284.9 |

(Continued)

FOREIGN PATENT DOCUMENTS

| | | | |
|---|---|---|---|
| EP | 0 958 959 A2 | | 11/1999 |
| JP | 6-72214 | * | 3/1994 |

*Primary Examiner*—Laurie K. Cranmer
(74) *Attorney, Agent, or Firm*—Cooley Godward LLP

(57) ABSTRACT

An infant support structure having a seat and an adjustment mechanism that is configured to adjust the receiving area of the seat.

23 Claims, 10 Drawing Sheets

U.S. PATENT DOCUMENTS 4,823,405 A 4/1989 Porter
D304,256 S 10/1989 McEntee
4,913,491 A 4/1990 Mizuno et al.
4,938,529 A 7/1990 Fourrey
4,993,090 A 2/1991 Ranalli
5,022,709 A 6/1991 Marchino
5,098,157 A 3/1992 Surot
D329,248 S 9/1992 Brown
5,243,724 A 9/1993 Barnes
5,366,277 A * 11/1994 Tremblay ..... 297/464
5,437,061 A 8/1995 Kenner
5,441,328 A 8/1995 Snyder
5,611,095 A 3/1997 Schneider
5,645,317 A 7/1997 Onishi et al.
5,681,083 A * 10/1997 Nelson et al. ..... 297/284.1
5,681,084 A 10/1997 Yoneda
5,781,946 A 7/1998 McEntire et al.
5,810,445 A 9/1998 Surot
5,842,739 A 12/1998 Noble
5,857,743 A 1/1999 Ligon, Sr. et al.
5,860,696 A 1/1999 Opsvik et al.
5,897,164 A 4/1999 Kagan et al.
5,913,569 A 6/1999 Klingler
5,916,089 A 6/1999 Ive
5,918,933 A 7/1999 Hutchinson et al.
5,950,261 A 9/1999 Hay et al.
5,956,766 A 9/1999 Benway
5,956,767 A 9/1999 Imm
5,988,742 A 11/1999 Stevens
6,007,151 A 12/1999 Benson
6,012,189 A 1/2000 Dudley
6,045,183 A 4/2000 Weber
6,053,064 A 4/2000 Gowing et al.
6,055,686 A 5/2000 Knight
6,068,336 A 5/2000 Schonauer
D430,079 S 8/2000 Catron-Batts
6,105,168 A 8/2000 Hazen
D431,377 S 10/2000 Buggs
6,139,102 A 10/2000 von Möller
6,145,932 A 11/2000 Hamel-Nyhus et al.
6,257,664 B1 * 7/2001 Chew et al. ..... 297/284.9
6,460,933 B1 * 10/2002 Bors et al. ..... 297/440.2
6,471,222 B1 10/2002 Hsia
6,682,143 B2 1/2004 Amirault et al.
2004/0017100 A1 1/2004 Gold et al.

* cited by examiner

ADJUSTABLE SUPPORT STRUCTURE AND METHOD OF USING THE SAME

BACKGROUND OF THE INVENTION

This invention relates generally to a support structure, and more particularly, to an adjustable high chair.

Conventional support structures, such as high chairs, are typically used to support young children during feeding and other activities. In general, conventional high chairs have a single size and/or configuration, and therefore, sometimes do not comfortably fit different sized children. Parents may need to purchase different sized support structures or one or more inserts that can be used to adjust the size of the support structure to accommodate different sized children.

A need exists for a support structure that can be adjusted to fit children of different sizes.

SUMMARY OF THE INVENTION

A support structure includes a seat and an adjustable portion that is coupled to the seat. In one embodiment, the adjustable portion is pivotable relative to the seat. The seat includes an actuator that can be moved relative to the adjustable portion to dispose the adjustable portion in multiple positions.

In another embodiment, the seat includes adjustable portions that are pivotally coupled to the seat. In this embodiment, the seat includes actuators that can be moved relative to the adjustable portions to dispose the adjustable portions in multiple positions. The adjustable portions can be positioned to change the size of a receiving area of the support structure. In one embodiment, the actuators are independently movable.

DETAILED DESCRIPTION OF THE INVENTION

A support structure includes a seat and an adjustable portion that is coupled to the seat. In one embodiment, the adjustable portion is pivotable relative to the seat. The seat includes an actuator that can be moved relative to the adjustable portion to dispose the adjustable portion in multiple positions.

In another embodiment, the seat includes adjustable portions that are pivotally coupled to the seat. In this embodiment, the seat includes actuators that can be moved relative to the adjustable portions to dispose the adjustable portions in multiple positions. The adjustable portions can be positioned to change the size of a receiving area of the support structure. In one embodiment, the actuators are independently movable.

Figure 1:
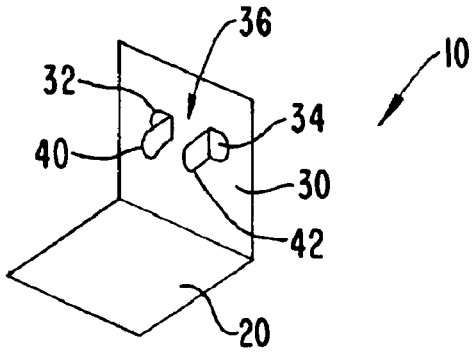
FIG. 1 is a front schematic view of an embodiment of a support structure according to the invention.
Figure 2:
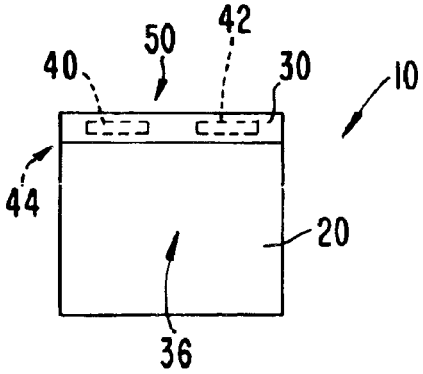
FIG. 2 is a top schematic view of the support structure of FIG. 1 in a first configuration.
Figure 3:
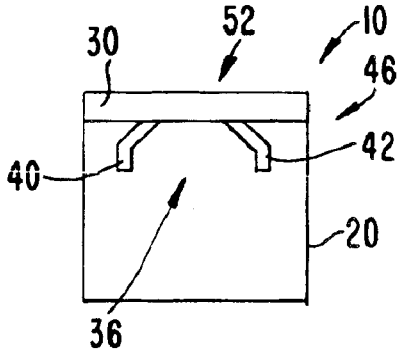
FIG. 3 is a top schematic view of the support structure of FIG. 1 in a second configuration.

A perspective schematic view of an embodiment of a support structure according to the present invention is illustrated in FIGS. 1–3. In the illustrated embodiment, the support structure 10 is a high chair for an infant or a child. In alternative embodiments, the support structure may be any other structure that can support a child or infant, such as a swing, a stroller, a bassinet, a play yard, etc. The support structure can be referred to alternatively as a child support structure or an infant support structure.

Support structure 10 includes a support portion 20 and a back portion 30. The back portion 30 includes openings 32 and 34 formed therein. As illustrated in FIG. 1, the openings 32 and 34 are located inwardly and spaced apart from the perimeter of the back portion 30.

In the illustrated embodiment, the support portion 20 is integrally formed with the back portion 30. In an alternative embodiment, the support portion 20 and the back portion 30 are separately formed and coupled together.

The support structure 10 includes supports or support members 40 and 42. The supports 40 and 42 are pivotally mounted in the openings 32 and 34 of the back portion 30. The supports 40 and 42 are selectively disposable in retracted positions 44 in alignment with the back portion 30 (see FIG. 2) and in extended positions 46 in which the supports 40 and 42 extend forwardly from the back portion 30 (see FIG. 3). When the supports 40 and 42 are in their first positions 44, the support structure 10 has a first configuration 50. When the supports 40 and 42 are in their second positions 46, the support structure 10 has a second configuration 52.

The seat portion 20, the back portion 30 and the support members 40 and 42 collectively define a receiving area 36 in which an infant or child can be placed. The size and configuration of the receiving area 36 is different in the first and second configurations 50 and 52. As illustrated in FIGS. 2 and 3, the size of the receiving area 36 is smaller when the support members 40 and 42 are moved to their extended positions 46. The smaller receiving area 36 provides additional comfort and stability for the occupant of the support structure 10.

Figure 4:
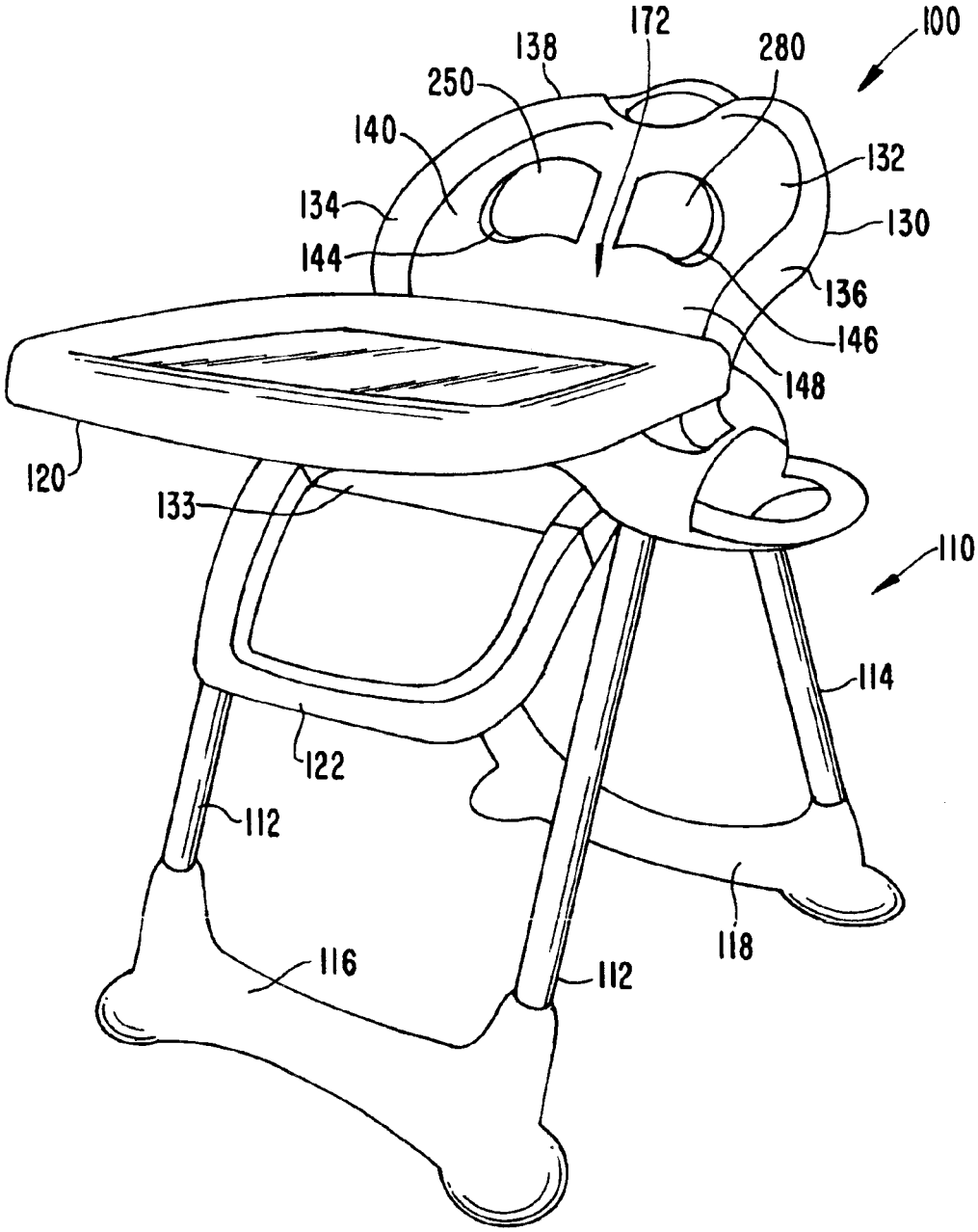
FIG. 4 is a front perspective view of another embodiment of an infant support structure according to the invention.

An alternative embodiment of a support structure according to the invention is illustrated in FIG. 4. In this embodiment, the support structure 100 is a high chair for an infant or a child. In alternative embodiments, the support structure may be any other structure as described above with respect to support structure 10.

The support structure 100 includes a frame 110, a tray 120, a footrest 122, and a seat or seat portion 130. In one embodiment, the frame 10 includes front legs 112 and rear legs 114 that are coupled to bases 116 and 118, respectively. Bases 116 and 118 are configured to engage a support surface on which the support structure 100 is placed.

The seat 130 includes a seat back 132 and a seat bottom 133. In this embodiment, the seat back 132 and the seat bottom 133 are integrally formed. In an alternative embodiment, the seat back 132 and the seat bottom 133 can be separately formed and coupled together.

The seat back 132 has side walls 134 and 136 that form part of the perimeter 138 of the seat back 132. The seat back 132 also includes a front surface 140 and a rear surface 142. In the illustrated embodiment, the seat back 132 includes openings 144 and 146 formed in the front surface 140.

The front surface 140 defines an interior surface 148 that forms part of a receiving area 172 in which a child or infant can be placed. The seat bottom 133 also defines a portion of the receiving area 172. The occupant of the support structure 100 in the receiving area 133 can access the tray 120.

In the illustrated embodiment, the support structure 100 includes supports 250 and 280. Supports 250 and 280 are pivotally coupled to the seat back 132. As discussed in detail later, the supports 250 and 280 are movable between several positions relative to the seat back 132. The supports can be referred to alternatively as adjustable portions and support members.

Figure 5:
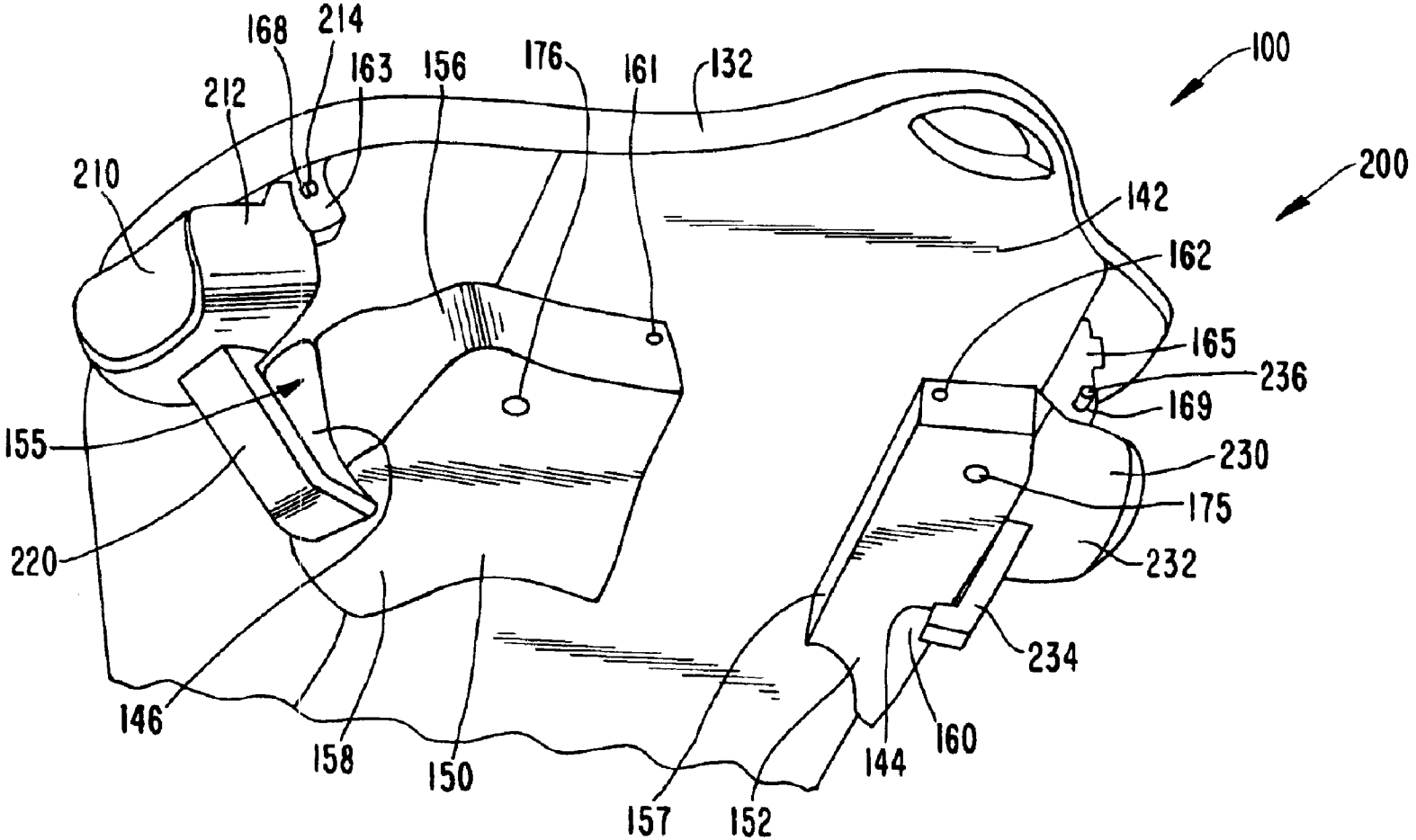
FIG. 5 is a rear perspective view of the support structure of FIG. 4.
Figure 6:
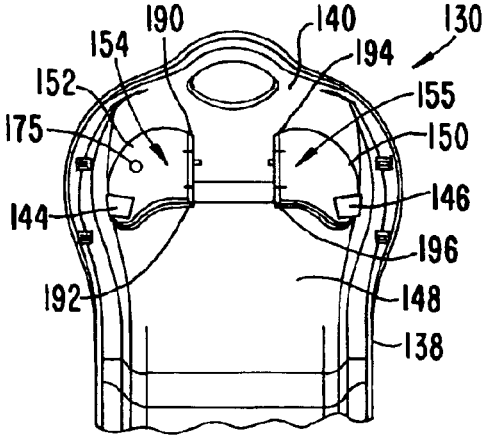
FIG. 6 is a front view of an embodiment of a seat according to the invention.

A rear perspective view of the seat 130 is illustrated in FIG. 5. The seat back 132 includes a rear surface 142 and mounting structures 150 and 152. In this embodiment, the mounting structures 150 and 152 extend rearwardly from the rear surface 142 of the seat back 132.

In the illustrated embodiment, mounting structure 150 includes a rear wall 158 and a side wall 156 that extends around the perimeter of the rear wall 158. The rear wall 158 and the side wall 156 define a cavity 155 therebetween. Support member 280 is pivotally mounted to the mounting structure 150 as described in detail later. The rear wall includes an opening 176.

In one embodiment, the side wall 156 includes an upper opening 161 and a lower opening (not shown). The support member 280 is mounted to the side wall 156 via the openings in the side wall 156. The side wall 156 and the rear wall 158 also define an opening 146 in communication with the cavity 155.

Similarly, mounting structure 152 includes a rear wall 160 and a side wall 157 that extends around the perimeter of the rear wall 160. The rear wall 160 and the side wall 157 define a cavity 154 therebetween. Support member 250 is pivotally mounted to the mounting structure 152 as described in detail later. The rear wall 160 includes an opening 175.

In one embodiment, the side wall 157 includes an upper opening 162 and a lower opening (not shown). The support member 250 is mounted to the side wall 157 via the openings in the side wall 157. The side wall 157 and rear wall 160 also define an opening 144 in communication with the cavity 154.

In the illustrated embodiment, the support structure 100 includes an adjustment mechanism 200. The adjustment mechanism 200 includes the support members 250 and 280. The adjustment mechanism 200 also includes actuators or handles 210 and 230 that are pivotally coupled to the seat back 132. The actuators 210 and 230 are configured to selectively engage and move the support members 250 and 280.

Figure 12:
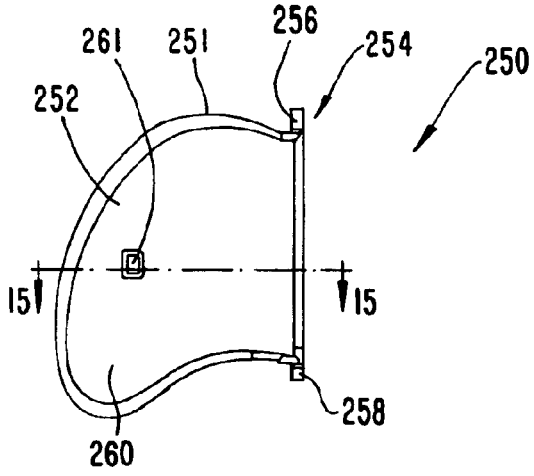
FIG. 12 is a front view of an embodiment of a support according to the present invention.

As illustrated in FIG. 5, the actuator 210 includes a body 212 and an extension 220. The body 212 is integrally formed with the extension 220. In an alternative embodiment, the body 212 and the extension 220 can be formed separately and coupled together. The actuator 210 is discussed in detail with respect to FIGS. 12–14.

Similarly, the actuator 230 includes a body 232 and an extension 234. The body 232 is integrally formed with the extension 234. In an alternative embodiment, the body 232 and the extension 234 can be formed separately and coupled together.

The actuators 210 and 230 are pivotally coupled to the seat back 132. The actuators 210 and 230 are located proximate to mounting structures 150 and 152, respectively. As illustrated in FIG. 5, the actuator 210 is mounted so that the extension 220 of the actuator 210 extends through opening 146 and engages support member 280. The actuator 230 is mounted so that the extension 234 of the actuator 230 extends through the opening 144 and engages support member 250.

In one embodiment, the seat back 132 includes several sets of flanges that extend from the rear surface 142 of the seat back 132. The actuators 210 and 230 are pivotally coupled to the flanges. Some of the flanges are illustrated in FIG. 5.

In one embodiment, flange 163 extends from the rear surface 142. Flange 163 includes an opening 168. The opening 168 is configured to receive a protrusion 214 located on the actuator 210 as discussed in detail later.

Similarly, flange 165 extends from the rear surface 142 and includes an opening 169. Opening 169 is configured to receive a protrusion 236 located on the actuator 230 as discussed in detail later.

An embodiment of a seat according to the invention is illustrated in FIGS. 6–8B. In this embodiment, the seat 130 includes a front surface 140 and rear surface 142. As discussed above, the front surface 140 includes an interior surface 148 that is located inwardly from the perimeter 138 of the seat 130.

The seat back 132 includes mounting structures 150 and 152 that are coupled to the seat back 132. The mounting structures 150 and 152 define cavities 155 and 154 in which the supports 280 and 250 are mounted, respectively.

The seat back 132 includes coupling locations 190 and 192 located proximate to the mounting structure 152. Each of the coupling locations 190 and 192 includes an opening (not shown) in which an extension located on the support 250 is inserted. The support 250 is mounted to the coupling locations 190 and 192 and can pivot about the extensions relative to the front surface 140 of the seat back 132. The support is described in detail with respect to FIGS. 12–16.

Similarly, the seat back 132 includes coupling locations 194 and 196 located proximate to the mounting structure 150. Each of the coupling locations 194 and 196 includes an opening (not shown) in which an extension located on the support 280 is inserted. The support 280 is mounted to the coupling locations 194 and 196 and can pivot about the extensions relative to the front surface 140 of the seat back 132.

Figure 7:
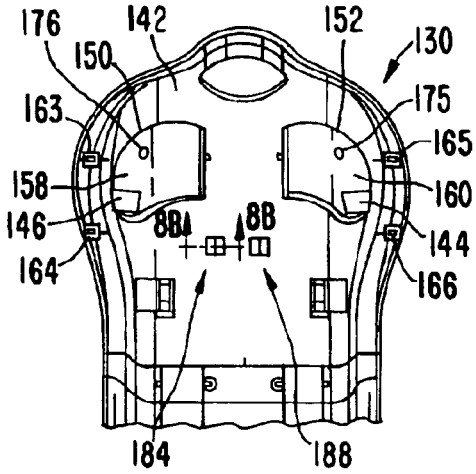
FIG. 7 is a rear view of the seat of FIG. 6.
Figure 8A:
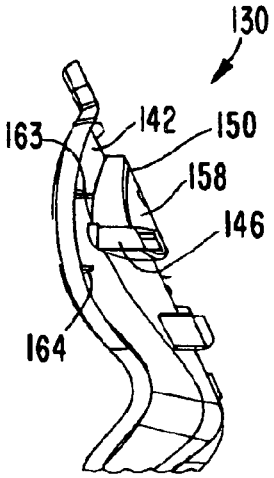
FIG. 8A is a side view of the seat of FIG. 6.

As illustrated in FIGS. 7 and 8A, the seat back 132 includes a pair of flanges 163 and 164 coupled to the rear surface 142. Flange 163 includes opening 168 in which a protrusion on the actuator 210 is inserted. Similarly, flange 164 includes an opening (not shown) in which another protrusion on the actuator 210 is inserted. The actuator 210 is mounted to the flanges 163 and 164 and can pivot about the protrusions relative to the rear surface 142.

The seat back 132 includes a pair of flanges 165 and 166 coupled to the rear surface 142. Flange 165 includes an opening 169 in which a protrusion on the actuator 230 is inserted. Similarly, flange 166 includes an opening (not shown) in which another protrusion on the actuator 230 is inserted. The actuator 230 is mounted to the flanges 165 and 166 and can pivot about the protrusions relative to the rear surface 142.

Figure 8B:
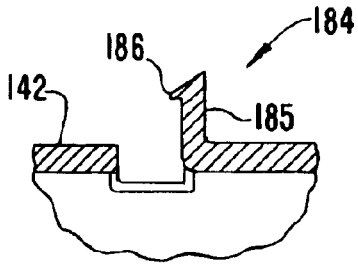
FIG. 8B is a cross-sectional side view of a hook of the seat of FIG. 7 taken along the line 8B—8B.

The seat back 132 also includes hooks or catches 184 and 188 coupled to the rear surface 142 of the seat back 132. Hook 184 is illustrated in FIG. 8B. In one embodiment, hook 184 includes a stand 185 and a protrusion 186 proximate to an end of the stand 185. In the illustrated embodiment, hook 188 can have a structure that is substantially similar to hook 184. As described in detail below, biasing elements that are used to bias the supports 250 and 280 are coupled to the hooks 184 and 188. In an alternative embodiment, the biasing elements can be coupled to a single hook or catch disposed on the rear surface 142 of the seat back 132.

Figure 9:
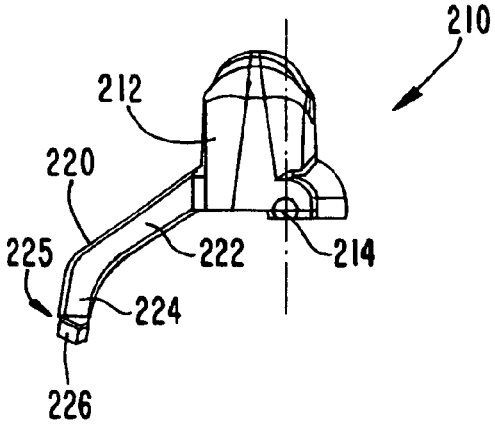
FIG. 9 is a top view of an embodiment of an actuator according to the invention.
Figure 10:
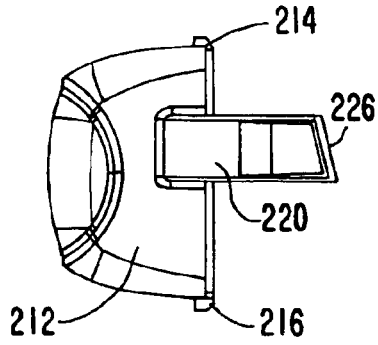
FIG. 10 is a side view of the actuator of FIG. 9.
Figure 11:
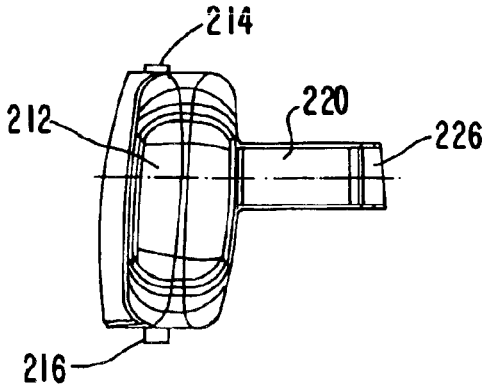
FIG. 11 is a front view of the actuator of FIG. 9.

An embodiment of an actuator according to the present invention is illustrated in FIGS. 9–11. In this embodiment, the structures of the actuators 210 and 230 are mirror images of each other, and therefore, only actuator 210 is discussed in detail. Actuator 210 can be referred to alternatively as a handle or an adjustment handle.

Actuator 210 includes a body portion 212 and an extension 220. The body portion 212 can have any shape or configuration that enables a user to manipulate the actuator 210.

The body portion 212 includes protrusions 214 and 216 that extend outwardly from opposite ends of the body portion 212. Protrusions 214 and 216 are configured to engage the openings formed in flanges 163 and 164 on the rear surface 142 of the seat back 132. As illustrated in FIG. 10, each of the protrusions 214 and 216 has a tapered portion. The tapered portions facilitate the coupling of the actuator 210 to the seat back 132 by providing a surface that allows the actuator 210 to be snap fit into place on the flanges 163 and 164.

The extension 220 extends outwardly from the body portion 210 as illustrated in FIG. 9. In one embodiment, the extension 220 includes a first portion 222 and a second portion 224 that is oriented at an angle with respect to the first portion 222. The distal end 225 of the second portion 224 includes a cam surface 226. The cam surface 226 is angled or tapered with respect to the extension 220 as illustrated in FIG. 10.

An embodiment of a support according to the present invention is illustrated in FIGS. 12–16. In this embodiment, the structures of the supports 250 and 280 are mirror images of each other, and therefore, only support 250 is discussed in detail. Support 250 can be referred to alternatively as a support member or an adjustable portion.

In this embodiment, the support 250 has a perimeter 251 and includes a contact portion 252 and a mounting portion 254. The perimeter 251 has substantially the same shape or configuration as opening 144 in the seat back 132. The support 250 is sized so that it can be received in the cavity 155 and be flush with the front surface 140 of the seat back 132.

Figure 17:
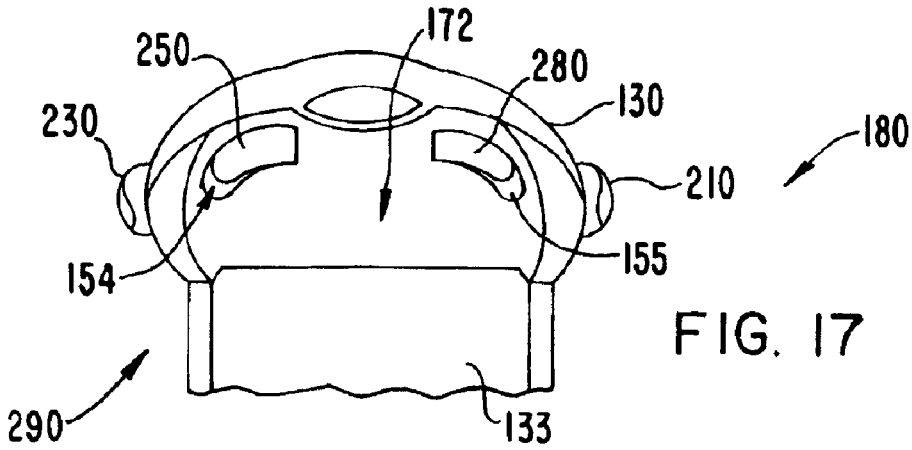
FIG. 17 is a top view of the support structure of FIG. 4 in a first configuration.
Figure 18:
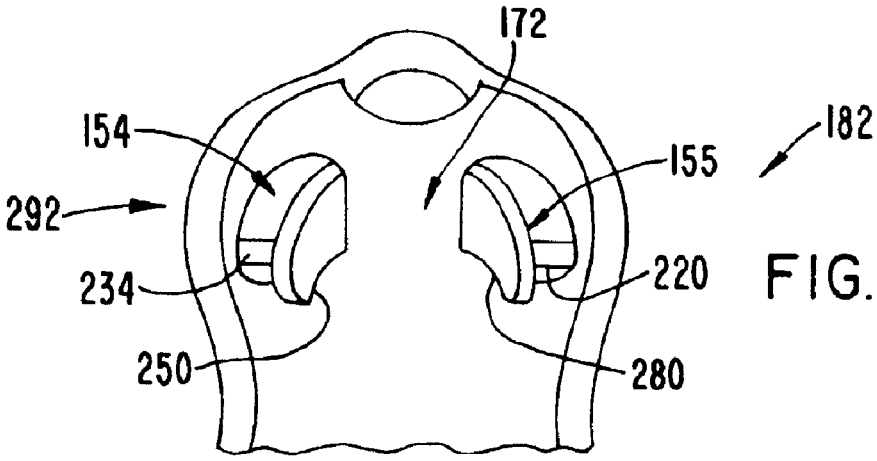
FIG. 18 is a top view of the support structure of FIG. 4 in a second configuration.

The contact portion 252 includes a front surface 260 and a rear surface 262. During the use of the support structure 100, the front surface 260 is the surface that engages the occupant of the seat 130 (or a liner or other structure that engages the occupant). In the illustrated embodiment, the front surface 260 has a curved or contoured configuration as shown in FIGS. 17 and 18. In alternative embodiments, the front surface can have any shape or configuration.

Figure 13:
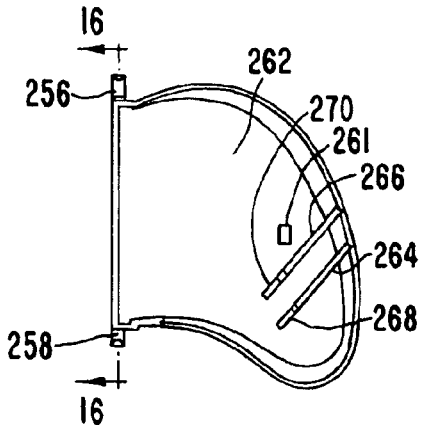
FIG. 13 is a rear view of the support of FIG. 12.
Figure 15:
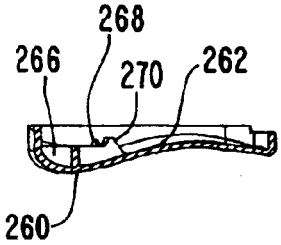
FIG. 15 is a cross-sectional top view of the support of FIG. 12 taken along the line 15—15.
Figure 14:
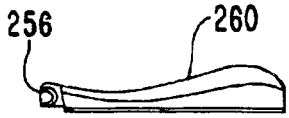
FIG. 14 is a top view of the support of FIG. 12.

Referring to FIGS. 13 and 15, the actuator 250 includes ribs 264 and 266 coupled to the rear surface 262. Each of the ribs 264 and 266 has an abutment 268 and 270, respectively, located proximate to an end of the particular rib. In this embodiment, the ribs 264 and 266 are oriented at an angle with respect to a horizontal plane. The ribs 264 and 266 are oriented at an angle that follows the trajectory of the tapered surface 226 on the extension 220 of actuator 210 as the actuator 210 rotates. In one embodiment, the angle of the tapered surface 226 is copied based on the orientation of the ribs 264 and 266.

Figure 16:
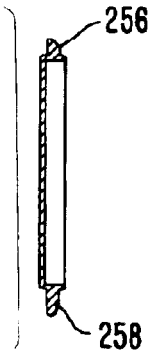
FIG. 16 is a cross-section side view of the support of FIG. 13 taken along the line 16—16.

The mounting portion 254 includes posts or extensions 256 and 258 that extend in opposite directions from the support 250. As illustrated in FIG. 16, each of the extensions 256 and 258 includes a tapered surface that facilitates the coupling of the support 250 to the seat back 132. In the illustrated embodiment, the support 250 includes an opening 261 extending from the front surface 260 to the rear surface 262.

Now the operation of an embodiment of a support structure according to the invention is described with reference to FIGS. 17–19. Initially, the supports 250 and 280 are mounted in the cavities 154 and 155 of the seat back 132 and the actuators 210 and 230 are coupled to the flanges 163–166.

When the supports 250 and 280 are located in the cavities 154 and 155, the supports 250 and 280 are in their retracted positions 290 as illustrated in FIG. 17. In these positions, the front surfaces 260 and 281 of the supports 250 and 280 are substantially aligned with the front surface 140 of the seat back 132 and the seat 130 has a first configuration 180.

An infant or child is placed in the receiving area 172 of the seat 130. If the caregiver wants to change the size of the receiving area 172, for example, to make it smaller, the caregiver can manipulate the actuators 210 and 230 to move the supports 250 and 280 to their extended positions 292 illustrated in FIG. 18 (see the direction of arrow "A"). In the illustrated embodiment, the actuators 210 and 230 are independently movable.

Actuator 210 can be moved inwardly to engage the rear surface 282 of support 280. As the actuator 210 is moved inwardly, the cam surface 226 at the end of the extension 220 engages and passes over the abutments 288 and 289 on the ribs 284 and 286. Once the cam surface 226 passes over the abutments 288 and 289, the cam surface 226 can travel along the ribs 284 and 286 on the rear surface 282 of the support 280. The frictional engagement of the cam surface 226 on the ribs 284 and 286 enables the support 280 to be moved into and positioned at a number of locations with respect to the seat back 132. When force is applied to the support 280, the support 280 moves rearwardly until the cam surface 226 engages the abutments 288 and 289 on ribs 284 and 286.

Figure 19:
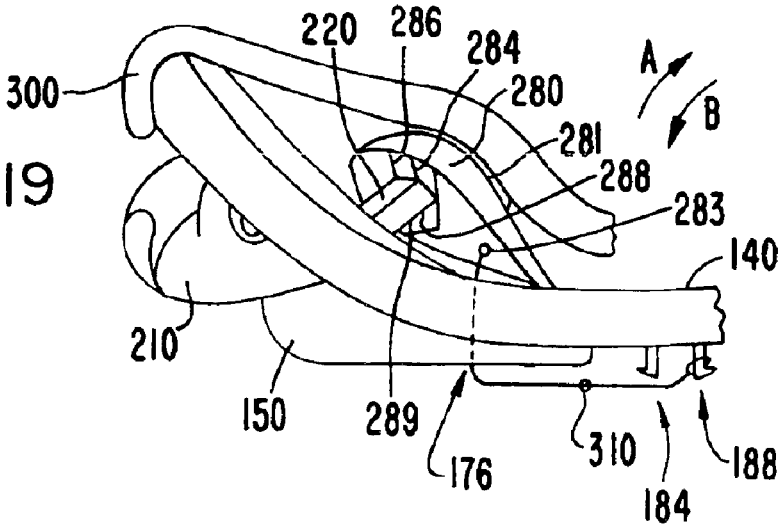
FIG. 19 is a top view of a portion of the support structure of FIG. 18.

The support 280 is illustrated in an extended position in FIG. 19. In this orientation, the extension 220 of actuator 210 is moved along the ribs 284 and 286 on support 280. The actuator 210 can be moved until the extension 220 engages the abutments 288 and 289.

Actuator 230 can be moved inwardly to engage the rear surface 252 of support 250. As the actuator 230 is moved, the cam surface at the end of the extension 234 engages the abutments 268 and 270 on the ribs 264 and 266 on the rear surface 252 of the support 250. Once the cam surface passes over the abutments 268 and 270, the frictional engagement of the cam surface on the ribs 264 and 266 enables the support 250 to be moved into and positioned at a number of locations with respect to the seat back 132. When force is applied to the support 250, the support 250 moves rearwardly until the cam surface of the actuator 230 engages the abutments 268 and 270 on ribs 264 and 266.

The supports 250 and 280 can be moved into their extended positions 292 and the seat 130 has a corresponding second configuration 182 as illustrated in FIG. 18. In this configuration 182, the receiving area 172 of the seat 130 is smaller than in the first configuration 180.

When the user wants to increase the size of the receiving area 172, the user pivots the actuators 210 and 230 inwardly along the direction of arrow "B" to their retracted positions 290 illustrated in FIG. 17. If sufficient force is applied to the actuators 210 and 230, the extensions of the actuators 210 and 230 will ride up and over the abutments on the respective supports 250 and 280. When the actuators 210 and 230 are pivoted out of engagement from the supports 250 and 280, each of the supports 250 and 280 is biased to its retracted position 290 by a corresponding biasing element.

In one embodiment, the support structure includes a softgoods material 300 can be placed on the seat 130 in a conventional manner (see FIG. 19). The softgoods material 300 includes an elastic member 310, such as an elastic band, that is coupled to the rear surface of the softgoods material 300. The elastic member 310 inserted through the opening 283 on the support 280 and through the opening 176 in the mounting structure 150. One end of the elastic member 310 is coupled to hook 188 on the rear surface 142 of the seat back 132. The elastic member 310 can be coupled to the hook 188 in any conventional manner, including forming a loop that can be placed over the hook 188.

In the illustrated embodiment, the softgoods material 300 includes another elastic member (not shown) that used relative to support 250 and mounting structure 152 in the same manner as elastic member 310. The elastic members can be coupled to the same hook or different hooks on the rear surface 142 of the seat back 132.

The elastic member 310 pulls the softgoods material 300 rearwardly, thereby biasing the support 280 rearwardly toward its retracted position with respect to the seat back 132. When the support 280 is in its extended position, the rearward movement of the support 280 is limited by the engagement of the cam surface 226 with the abutments 288 and 289 on the rear surface of the support 280. The user can apply the necessary force to the actuator 210 to move the cam surface 226 up and over the abutments 288 and 289 to allow the support 280 to move to its retracted position.

Figure 20:
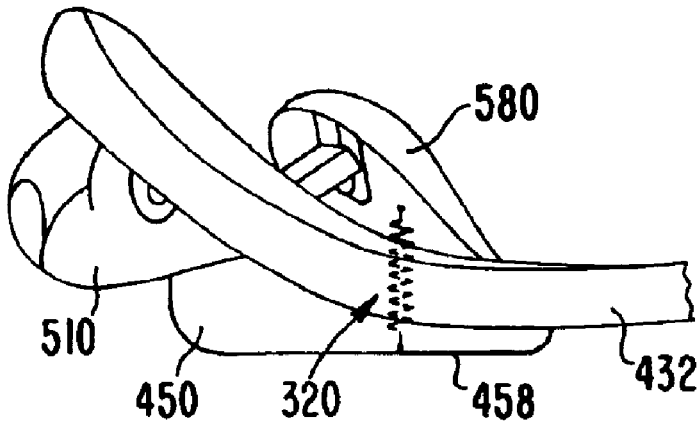
FIG. 20 is a top view of a portion of an alternative support structure according to the present invention.

An alternative embodiment of a portion of a support structure according to the present invention is illustrated in FIG. 20. In this embodiment, the actuator 510, the support 580, and the seat back 432 are substantially the same as actuator 210, support 280, and the seat back 132 previously described. The support 580 is biased rearwardly with respect to the seat back 432 by a biasing element 320. In this embodiment, the biasing element 320 is coupled to a rear surface of the support 580 and to the rear wall 458 of the mounting structure 450. In one implementation, the biasing element 320 can be a spring. In other implementations, any structure that can bias the support 580 rearwardly with respect to the seat back 432 can be used.

Figure 21:
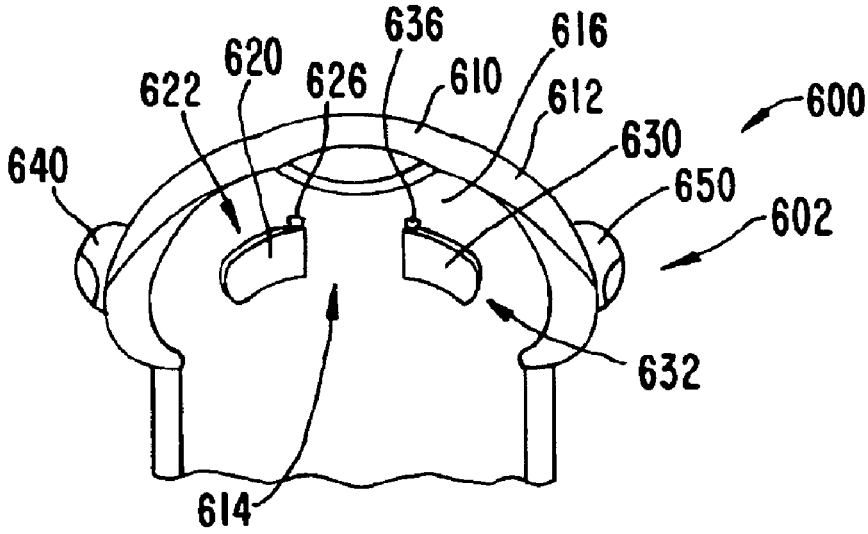
FIG. 21 is a top view of another embodiment of a support structure in a first configuration according to the present invention.
Figure 22:
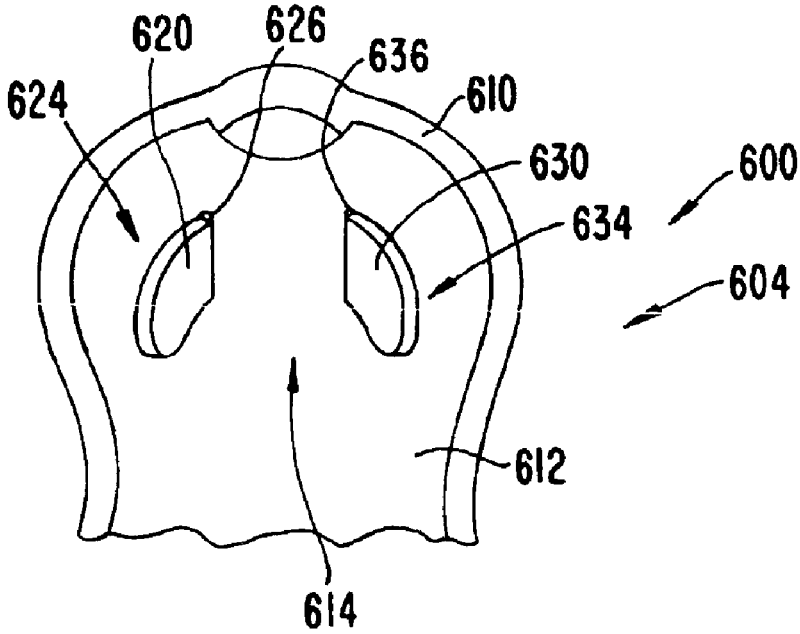
FIG. 22 is a top view of the support structure of FIG. 21 in a second configuration.

An alternative embodiment of an infant support structure is illustrated in FIGS. 21 and 22. The support structure 600 includes a seat 610 with a seat back 612 that defines a portion of a receiving area 614. In this embodiment, the seat 610 includes a pair of supports 620 and 630 that are coupled to the seat 610. The seat 610 also includes a pair of actuators 640 and 650 that can be manipulated to move the supports 620 and 630, respectively, in a manner substantially similar to actuators 210 and 230.

In this embodiment, the seat back 612 does not include any cavities or recesses in its front surface 616. Each of the supports 620 and 630 is movably coupled to the seat back 612 and thus, is not located in a cavity. In one embodiment, the supports 620 and 630 are pivotally coupled to the seat back 612. In an alternative embodiment, the supports 620 and 630 can be coupled to the seat back 612 for translational or linear movement relative thereto.

The supports 620 and 630 can be coupled to the front surface 616 of the seat 610. For example, upper and lower flanges 626 (only the upper flange being shown) and upper and lower flanges 636 (only the upper flange being shown) can be coupled to and extend from the front surface 616 of the seat 610.

Support 620 can be pivotally mounted on flanges 626. Similarly, support 630 can be pivotally mounted on flanges 636. In one embodiment, the supports 620 and 630 include pivot pins which can be integrally formed or coupled to the supports 620 and 630. Each of the pivot pins can be inserted into an opening in one of the corresponding flanges.

The supports 620 and 630 can be disposed in multiple positions that relate to different configurations of the seat 610. The supports 620 and 630 can be disposed in first or retracted positions 622 and 632, respectively, which correspond to configuration 602 of the seat 610 in which receiving area 614 is relatively large (see FIG. 21). The supports 620 and 630 are substantially in contact with or proximate to the front surface 616 of the seat back 610 in their retracted positions. In this embodiment, each of the supports 620 and 630 has a relatively small thickness.

The supports 620 and 630 can also be disposed in second or extended positions 624 and 634, respectively, which correspond to configuration 604 of the seat 610 in which receiving area 614 is relatively small (see FIG. 22).

Figure 23:
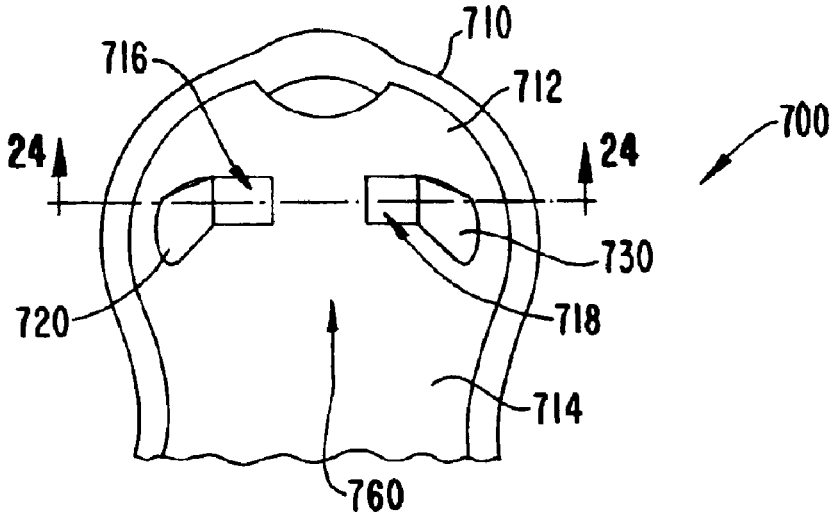
FIG. 23 is a top view of another embodiment of a support structure according to the present invention.
Figure 24:
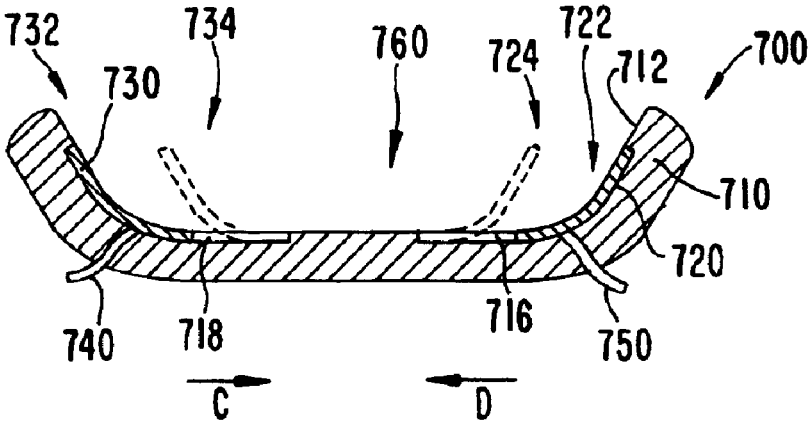
FIG. 24 is a cross-sectional top view of the support structure of FIG. 23 illustrating multiple configurations of the support structure.

An alternative embodiment of an infant support structure is illustrated in FIGS. 23 and 24. The support structure 700 includes a seat 710 with a seat back 712 that defines a portion of a receiving area 760. In this embodiment, the seat 710 includes a pair of supports 720 and 730 that are coupled to the seat 710. The seat back 712 includes recesses 716 and 718 formed in the front surface 714 of the seat back 712.

Support 720 is coupled to the seat back 712 for linear or translational movement. In one embodiment, support 720 includes pins (not shown) that can slidably engage slots formed in the seat back 712. The pins can be integrally formed or coupled to the support 720 and are configured to travel along the length of the slots in the seat back 712. The slots can be located in any of the surfaces that define the cavity 716.

Similarly, support 730 is coupled to the seat back 712 for linear or translational movement. In one embodiment, support 730 includes pins (not shown) that can slidably engage slots formed in the seat back 712. The slots can be located in any of the surfaces that define the cavity 716. In an alternative embodiment, the supports 720 and 730 can include a pinion that is engaged with a movable rack on the seat back to move the supports along the seat back.

In this embodiment, the seat 710 includes actuators 740 and 750 that are coupled to the supports 730 and 720, respectively. The actuators 740 and 750 can be manipulated by a user to move the supports 720 and 730 relative to the seat back 712. The actuators 740 and 750 can be inserted through holes or openings (not shown) in the seat back 712. The openings are configured to allow actuators 740 and 750 to move to control the movement of the supports 720 and 730.

In one embodiment, actuators 740 and 750 can be flexible fingers that are coupled to the supports 720 and 730. The engagement between the actuators 740 and 750 and the supports 720 and 730 can be any type of engagement, including a toothed engagement, a frictional engagement, or a pivotal engagement. The actuators 740 and 750 can have any structure that enables the actuators 740 and 750 to be retained in a particular position relative to the seat back 712, thereby retaining the supports 740 and 750 in their corresponding positions.

The supports 720 and 730 can be moved between retracted positions 722 and 733 and extended positions 724 and 734, respectively. The size of the receiving area 760 defined by the supports 720 and 730 and the front surface 714 of the seat back 712 changes when the supports 720 and 730 are placed in their various positions.

When a user moves actuator 740 along the direction of arrow "C," support 730 moves linearly from its retracted position 732 to its extended position 734 (shown in dashed lines). Similarly, when a user moves actuator 750 along the direction of arrow "D," support 720 moves from its retracted position 722 to its extended position 724. The actuators 740 and 750 can be moved in opposite directions to move the supports 720 and 730 from their extended positions to their retracted positions.

Figure 25:
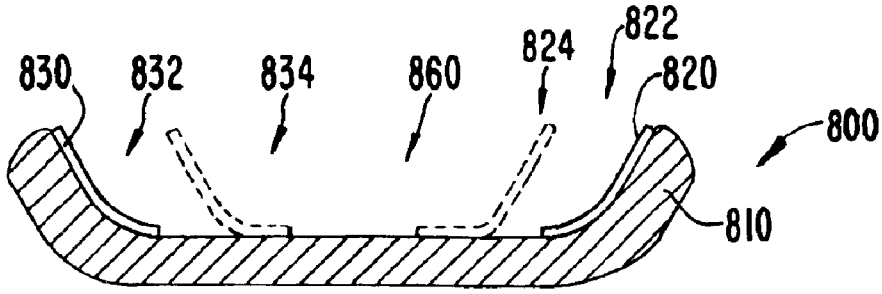
FIG. 25 is a cross-sectional top view of another embodiment of a support structure according to the present invention.

An alternative embodiment of a support structure according to the invention is illustrated in FIG. 25. In this embodiment, the support structure 800 includes a seat 810 that is similar to seat 710. The support structure 800 includes supports 820 and 830 that are movably coupled to the seat 810. In this embodiment, supports 820 and 830 are slidably coupled to the seat 810.

Supports 820 and 830 can be moved into retracted positions 822 and 832 and into extended positions 824 and 834. In this embodiment, supports 820 and 830 can be manipulated by a user without the assistance of any actuators. A user can slide the supports 820 and 830 between their respective positions.

In an alternative embodiment, the cavities of the seat back can extend to the outer perimeter of the seat back.

In an alternative embodiment, the support structure can include a seat back that does not include any cavities in which supports are located. In such an embodiment, the supports can be coupled to the seat back for linear or translational movement along the front surface of the seat back. The supports can be coupled to the seat back using any type of sliding connection, including a pin and slot arrangement or a rack and pinion type arrangement.

In an alternative embodiment, the supports coupled to a support structure can be moved simultaneously. In one example, the supports can be moved by a common actuator. In another example, the supports can be moved by actuators that are linked together for movement.

In alternative embodiments, the cam surface of the extension of the actuator can have any configuration. Similarly, the extension may include any number of portions, including a single straight portion.

In an alternative embodiment, the supports can be movably coupled to the seat back in any particular manner.

In alternative embodiments, the biasing element can have any structure that causes the support to move into its recessed position with respect to the seat back. Alternatively, the biasing elements can be coupled to any part of the support structure.

In an alternative embodiment, the support structure can use a single elastic member instead of two separate elastic members to bias the supports rearwardly.

In an alternative embodiment, a detent locking arrangement can be used to locate and secure a support in a particular orientation with respect to the seat back.

In an alternative embodiment, the actuators of the support structure can be arranged so that the actuators travel over center to retain the supports in their extended configurations. In this embodiment, no biasing elements are needed to retain the supports in their extended configurations.

In another embodiment, one of a hook or loop type material can be located on the rear surface of the softgoods and the other of the hook or loop type material can be located on the front surface of a support. The hook and loop type materials can be used to couple the softgoods material to the support. When the softgoods material is mounted on the support structure, the resiliency of the softgoods biases the supports rearwardly with respect to the seat back.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. A highchair comprising:

a frame; and a seat, said seat being coupled to said frame, said seat including:

a seat bottom;

a seat back coupled to said seat bottom, said seat back having a front surface, a rear surface and a perimeter, said seat back defining a cavity, said cavity being spaced from said perimeter;

a support coupled to said seat back, said support mounted proximate to said cavity, said support being moveable forwardly relative to said front surface of said seat back and being positionable within and movable through a portion of said cavity, movement of said support changing the configuration of said seat back.

2. The highchair of claim 1, said support being disposable in an extended position and in a retracted position, said support extending forwardly of said front surface of said seat back in said extended position, and said support being substantially aligned with said front surface of said seat back in said retracted position.

3. The highchair of claim 1, said support being a first support and said cavity being a first cavity, said seat back defining a second cavity, said seat including a second support coupled to said seat back, said second support mounted proximate to said second cavity, said second support being positionable within and movable through a portion of said second cavity.

4. The highchair of claim 3, said supports being disposable in extended positions and in retracted positions, said supports extending forwardly of said front surface of said seat back in said extended positions, and said supports being substantially aligned with said front surface of said seat back in said retracted positions.

5. The highchair of claim 4, said seat back having a first configuration when said first and second supports are disposed in their extended positions, and said seat back having a second configuration when said first and second supports are disposed in their retracted positions, said seat back front surface, said first support, and said second support collectively defining therebetween a receiving area configured to receive an infant, said receiving area being smaller in said first configuration than in said second configuration.

6. The highchair of claim 1, said seat back including a mounting structure, said support being pivotally coupled to said mounting structure.

7. The highchair of claim 6, said mounting structure including a wall extending from said rear surface, said wall defining a mounting opening, said support including a protrusion, said protrusion being engageable with said opening in said wall so as to pivotally couple said support to said seat back.

8. The highchair of claim 1, wherein said seat includes an actuator, said actuator being mounted to said seat back and being operatively engageable with said support, movement of said actuator causing movement of said support relative to said seat back.

9. The highchair of claim 8, wherein said actuator is pivotally mounted to said seat back.

10. The highchair of claim 1, said support being disposable in an extended position extending forwardly of said front surface and in a retracted position substantially in alignment with said front surface, said support being biased toward said retracted position.

11. A seat for an infant support structure comprising:

a seat bottom; and a seat back coupled to said seat bottom, said seat back having a perimeter and an interior surface defined by said perimeter, said seat back including an opening, a front surface and a rear surface, said seat back including an adjustable portion movable forwardly relative to said front surface, said adjustable portion being disposable in a first position substantially in alignment with said seat back and in a second position extending from said front surface, said adjustable portion being disposed within said interior surface and spaced apart from said perimeter of said seat back, said adjustable portion being mounted proximate to said opening and being disposable within said opening.

12. The seat of claim 11, said adjustable portion being disposable in a first position within said opening and in a second position extending forwardly from said seat back.

13. The seat of claim 11, said seat back including a handle coupled to said seat back, said handle being operatively coupled to said adjustable portion, and movement of said handle causing movement of said adjustable portion relative to said front surface.

14. The seat of claim 11, said adjustable portion being a first adjustable portion, said seat back including a second adjustable portion movable relative to said front surface, said second adjustable portion being spaced apart from said perimeter of said seat back.

15. The seat of claim 14, said front surface and said adjustable portions collectively defining therebetween a receiving area, said adjustable portions being movable relative to each other and to said front surface to change the size of said receiving area.

16. An adjustable high chair comprising:

a seat, said seat including a seat back having a perimeter, said seat back including an interior surface defined by said perimeter, said interior surface defining a portion of a receiving area, said receiving area being configured to accommodate a child disposed on said seat;

a support, said support being coupled to and moveable forwardly relative to said interior surface of said seat back; and an adjustment mechanism, said adjustment mechanism being configured to position said support proximate to a child located within said receiving area, said adjustment mechanism including a handle movably mounted on said seat, said handle being engageable with and configured to move said support relative to said seat back.

17. The adjustable high chair of claim 16, said interior surface of said seat back including a cavity, said support being selectively disposable within said cavity.

18. The adjustable high chair of claim 17, further comprising:

a biasing element, said biasing element being coupled to said seat back and to said support, said biasing element causing said support to move into engagement with said recessed cavity.

19. A highchair comprising:

a frame; and a seat, said seat being coupled to said frame, said seat including:

a seat bottom;

a seat back coupled to said seat bottom, said seat back having a perimeter and an interior space defined by said perimeter, said seat back having an opening spaced from said perimeter, a front, surface and a rear surface;

a support coupled to and moveable forwardly relative to said front surface of said seat back, said support mounted proximate to said front surface of said seat back, said support being positionable proximate to and extending from said front surface, movement of said support changing the configuration of said seat back, said support being mounted proximate to said opening and being disposable within said opening.

20. The highchair of claim 19, said support being disposable in an extended position and in a retracted position, said support extending forwardly of said front surface of said seat back in said extended position, and said support being substantially in contact with said front surface of said seat back in said retracted position.

21. The highchair of claim 20, said support being a first support, said seat including a second support coupled to said seat back, said seat back having a first configuration when said first and second supports are disposed in their extended positions, and said seat back having a second configuration when said first and second supports are disposed in their retracted positions, said seat back front surface, said first support, and said second support collectively defining therebetween a receiving area configured to receive an infant, said receiving area being smaller in said first configuration than in said second configuration.

22. A highchair comprising:

a frame; and a seat, said seat being coupled to said frame, said seat including:

a seat bottom;

a seat back coupled to said seat bottom, said seat back having a front surface and a rear surface, said seat back defining a cavity;

a support coupled to said seat back, said support mounted proximate to said cavity, said support being positionable within and movable through a portion of said cavity, movement of said support changing the configuration of said seat back, said support being disposable in an extended position extending forwardly of said front surface and in a retracted position substantially in alignment with said front surface, said support being biased toward said retracted position.

23. An adjustable high chair comprising:

a seat, said seat including a seat back having a perimeter, said seat back including an interior surface defined by said perimeter, said interior surface defining a portion of a receiving area and including a cavity, said receiving area being configured to accommodate a child disposed on said seat;

a support, said support being movably coupled to said interior surface of said seat back and being selectively disposable within said cavity;

an adjustment mechanism, said adjustment mechanism being configured to position said support proximate to a child located with said receiving area; and a biasing element, said biasing element being coupled to said seat back and to said support, said biasing element causing said support to move into engagement with said recessed cavity.

* * * * *